US008269645B2

(12) United States Patent
West et al.

(10) Patent No.: US 8,269,645 B2
(45) Date of Patent: Sep. 18, 2012

(54) RULE BASED DISPLAY SYSTEMS AND METHODS

(75) Inventors: Alan West, Camarillo, CA (US); Dustin Stevens-Baier, Ventura, CA (US); Daniel C. Johansson, Camarillo, CA (US)

(73) Assignee: Haas Automation, Inc., Oxnard, CA (US)

( * ) Notice: Subject to any disclaimer, the term of this patent is extended or adjusted under 35 U.S.C. 154(b) by 426 days.

(21) Appl. No.: 12/563,067

(22) Filed: Sep. 18, 2009

(65) Prior Publication Data

US 2011/0068945 A1 Mar. 24, 2011

(51) Int. Cl.
*G08B 5/00* (2006.01)

(52) U.S. Cl. ..... 340/691.6; 340/2.7; 340/825.23

(58) Field of Classification Search ..... 340/691.6, 340/686.5, 685, 691.1, 2.7, 825.23, 661
See application file for complete search history.

(56) References Cited

U.S. PATENT DOCUMENTS

| | | | | |
|---|---|---|---|---|
| 5,764,975 | A * | 6/1998 | Taniguchi et al. | 1/1 |
| 6,052,663 | A * | 4/2000 | Kurzweil et al. | 704/260 |
| 7,996,765 | B1 * | 8/2011 | Mitnick et al. | 715/235 |
| 2001/0034261 | A1 * | 10/2001 | Gadot et al. | 463/16 |
| 2003/0149600 | A1 * | 8/2003 | Williams | 705/5 |
| 2008/0154832 | A1 * | 6/2008 | Kral et al. | 706/47 |

* cited by examiner

*Primary Examiner* — Daniel Previl
(74) *Attorney, Agent, or Firm* — McDermott Will & Emery LLP

(57) ABSTRACT

Rule based display systems and methods are provided. In an aspect of the disclosure, a display screen is dynamically generated using one or more display boxes selected from a plurality of display boxes stored in memory. Each of the plurality of display boxes has rules associated with the display box. To generate the display screen, a rules module generates a set of conditions based on current conditions of the system. The rules module then compares the rules of each display box with the set of conditions to identify display boxes having rules that are satisfied by the set of rules. A display module then generates the display screen using the display boxes identified by the rules module, thereby dynamically generating the display screen.

20 Claims, 11 Drawing Sheets

RULE BASED DISPLAY SYSTEMS AND METHODS

FIELD

The present invention generally relates to display systems and methods and, more particularly, to rule based display systems and methods.

BACKGROUND

In a computer controlled system, information is presented to an operator on a display so that the operator can monitor the system. Typically, different types of information are displayed to the operator at different times depending, for example, on conditions of the system at a given time.

To program the system to display a particular type of information under specified conditions, a programmer has to scan through the operating program of the system to determine at which locations in the operating program the system will be in the specified conditions. The programmer then has to insert program code into the operating program at the determined locations to instruct the system to display the particular type of information. This process can be cumbersome for the programmer, which increases programming time, and is prone to programming error.

SUMMARY

Various aspects of the disclosure provide rule based display systems and methods. In one aspect of the disclosure, a display screen is dynamically generated using one or more display boxes selected from a plurality of display boxes stored in memory. Each of the plurality of display boxes has rules associated with the display box, in which the rules specify under which conditions the display box is to be displayed. To generate the display screen, a rules module generates a set of conditions for the system based on current conditions of the system. The rules module then compares the rules of each display box with the set of conditions to identify display boxes having rules that are satisfied by the set of conditions. A display module then generates the display screen using the display boxes identified by the rules module, thereby dynamically generating the display screen.

The rules based display systems and methods according to aspects of the disclosure allow a programmer to quickly and easily program under which conditions a display box is displayed by simply specifying rules for the display box that correspond to the desired conditions. This eliminates the need for the programmer to scan through the operating program of the system to determine at which locations in the operating program the system will be in the desired conditions and the need to insert program code into the operating program at the determined locations to instruct the system to display the display box.

Additional features and advantages of the invention will be set forth in the description below, and in part will be apparent from the description, or may be learned by practice of the invention. The advantages of the invention will be realized and attained by the structure particularly pointed out in the written description and claims hereof as well as the appended drawings.

It is to be understood that both the foregoing summary of the invention and the following detailed description are exemplary and explanatory and are intended to provide further explanation of the invention as claimed.

Figure 1:
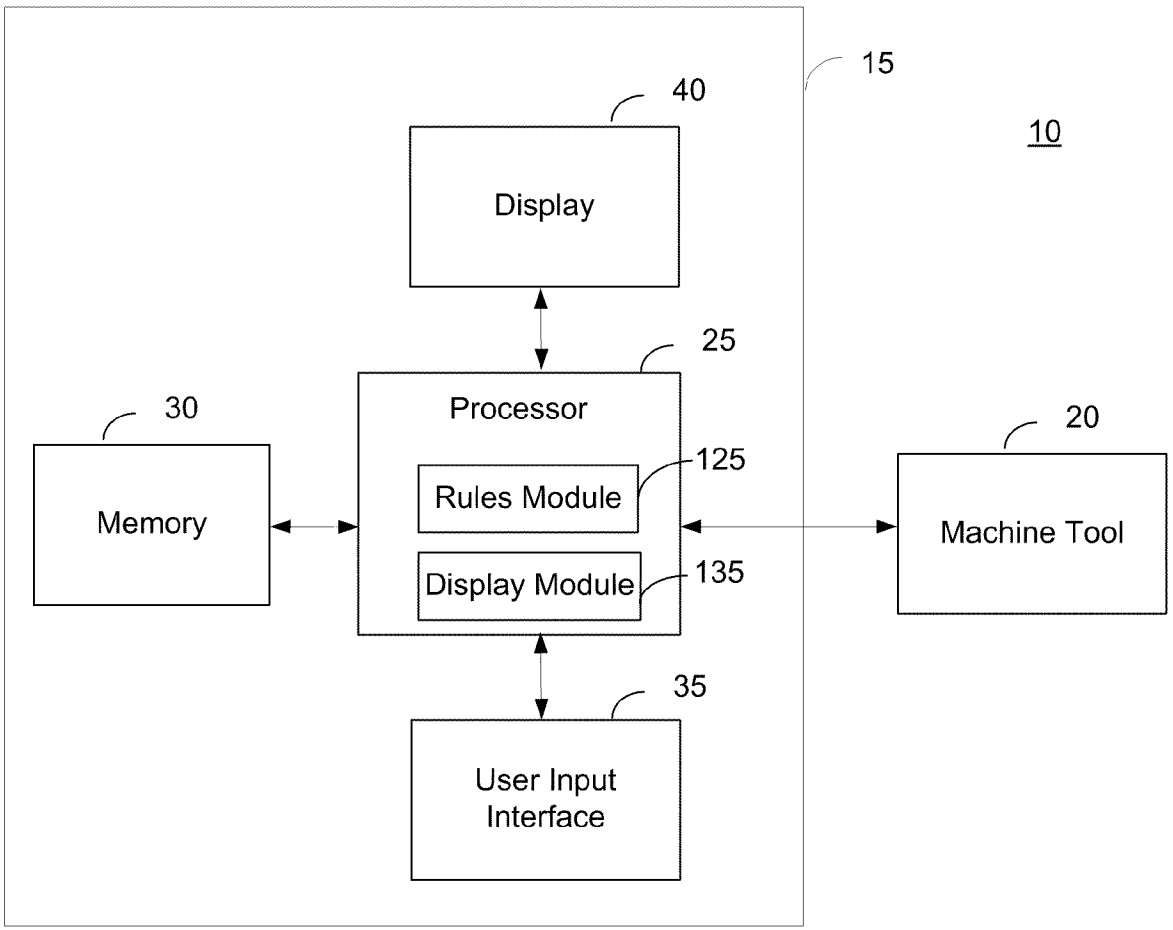
FIG. 1 is a block diagram of a computer numerical controlled (CNC) machine tool system according to an aspect of the disclosure.

The accompanying drawings, which are included to provide further understanding of the invention and are incorporated in and constitute a part of this specification, illustrate aspects of the invention and together with the description serve to explain the principles of the invention.

DETAILED DESCRIPTION OF THE INVENTION

In the following detailed description, numerous specific details are set forth to provide a full understanding of the present invention. It will be obvious, however, to one ordinarily skilled in the art that the present invention may be practiced without some of these specific details. In other instances, well-known structures and techniques have not been shown in detail to avoid obscuring concepts of the present invention.

Reference will now be made in detail to aspects of the subject technology, examples of which are illustrated in the accompanying drawings, wherein like reference numerals refer to like elements throughout.

Rule based display systems and methods according to various aspects of the disclosure are discussed using an example of a computer numerical controlled machine tool, although it is to be understood that the rule based display systems and methods can be applied to other types of computer controlled systems.

FIG. 1 is a block diagram of a computer numerical controlled (CNC) machine tool system 10 according to an aspect of the disclosure. The CNC machine tool system 10 includes a machine tool 20 and a controller 15. The machine tool 20 is configured to process a workpiece in accordance with commands received from the controller 15. The controller 15 includes a processor 25, memory 30, a user input interface 35 and a display 40. The processor 25 may comprise multiple processors. The controller 15 issues commands to the machine tool 20 based on program code executed by the processor 25 and/or input received from an operator via the user input interface 35. The user input interface 35 and the display 40 allow the operator to control and monitor operation of the controller 15 and the machine tool 20.

The machine tool 20 processes a workpiece into a desired form using one or more cutting tools. The workpiece and the cutting tools are positioned and operated using motors, actuators, servos, and other mechanisms known to those skilled in the art. Examples of machine tools 20 include, but are not limited to, vertical machining centers, horizontal machining centers, turning centers, and multi-axis machining centers. The operation of the machine tool 20 is controlled by the controller 15. Specifically, the controller 15 provides the machine tool 20 with control signals to control the cutting tools and various mechanisms within the machine tool 20 used to position and operate on the workpiece. The control signals may be generated based on program code executed by the processor 25 and/or user inputs.

The program code executed by the processor 25 may include instructions from an operating program and a user program. The operating program includes code for controlling the overall functionality of the system 10. For example, the operating program may include code for initiating operation of the system 10 at power-on or reset conditions. The operating program also includes code for facilitating communication between components within the system 10 and for managing computing resources (processor time, memory access and other resources) of the system 10. The operating program also includes code for executing one or more user programs. The user program includes instructions for performing a sequential process using the machine tool 20 to shape a workpiece into a desired form. The sequential process may include steps for selecting and mounting a cutting tool, positioning the cutting tool, positioning the workpiece, moving/operating the cutting tool relative to the workpiece, moving/rotating the workpiece relative to the cutting tool and other operations.

As discussed above, the user input interface 35 and display 40 allow an operator to control and monitor the operation of the system 10. For example, the user input interface 35 and display 40 may allow the operator to power-up or power-down the system 10, reset the system 10, select parameters, enter a new user program, select a user program from multiple existing user programs, monitor the position of the cutting tool, monitor the position of the workpiece, select positions for the cutting tool and/or the workpiece, enter individual instructions for operating the machine tool 20 and other operations.

The user input interface 35 may include a keyboard comprising various input keys. For example, the keyboard may comprise functions keys that perform different functions (e.g., depending on an operation mode of the system 10), cursor arrow keys, alpha-numeric keys, keys that perform specific functions, jog keys, and other input keys. The display 40 displays information to allow the operator to monitor the controller 15 and the machine tool 20. The display may comprise a Liquid Crystal Display (LCD), a Cathode Ray Tube (CRT) display or other suitable display. Examples of types of information that can be displayed to the operator are provided below.

The system 10 may operate in a plurality of different operation modes. For example, the operation modes may include an edit operation mode for allowing the operator to edit a user program, a memory operation mode for allowing the operator to select and run a user program from memory, a manual data input (MDI) operation mode for allowing the operator to manually enter data and commands to the system 10, direct numerical control (DNC) operation mode and other operation modes. In the DNC operation mode, a machining program for operating on a workpiece may be stored on a separate computer and sent directly to the machine tool 20, e.g., one block at a time. The user input interface 35 may include keys for the different operation modes to allow the operator to select one of the operation modes by pressing the corresponding key.

The system 10 may also have a plurality of display modes for displaying different types of information to an operator on the display 40. For example, the display modes may include a position display mode for displaying the position of a machine axis, a program display mode for displaying the current (active) program, a current commands display mode for displaying lines of a running program, an alarm display mode for displaying alarms, an offsets display mode and other display modes. The offsets display mode is a mode in which coordinates relative to a workpiece and/or machine tool 20 may be stored. The origin of the coordinates in the offsets display mode may be set at an arbitrary machine location so that positions in the display can be referenced relative to the machine location.

Examples of other modes in which the system 10 can operate can be found, for example, in "CNC Programming Handbook," by Peter Smid, Industrial Press, 2008.

Figure 4:
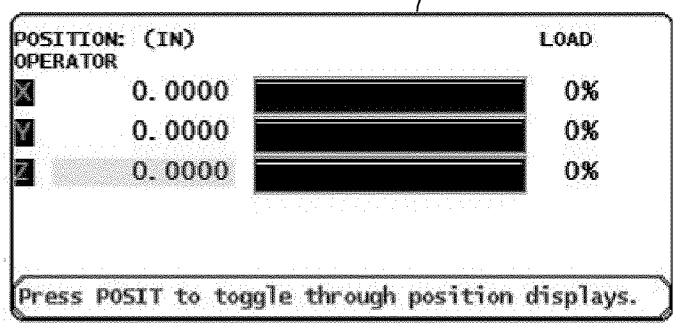
FIG. 4 shows an example of a positions display box according to an aspect of the disclosure.

In an aspect of the disclosure, the processor 25 generates a display screen that is displayed on the display 40 to provide information to the operator. The display screen may comprise one or more display boxes, where each display box presents certain information to the operator. Examples of different display boxes are shown in FIGS. 2-4.

Figure 2:
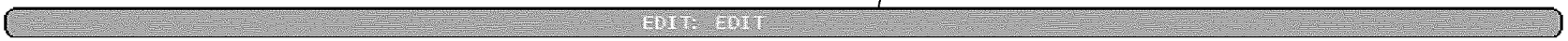
FIG. 2 shows an example of an operation mode display box according to an aspect of the disclosure.
Figure 3:
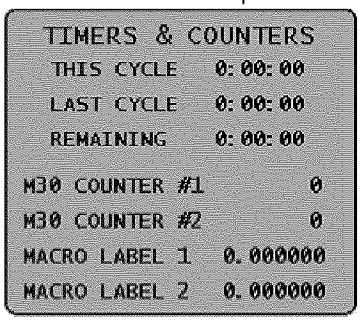
FIG. 3 shows an example of a timers display box according to an aspect of the disclosure.

FIG. 2 shows an example of an operation mode display box 210 that displays the current operation mode of the system 10. FIG. 3 shows an example of a timers display box 310 that displays various timers and counters. In this example, the timers display box 310 includes the time that a program has been running in a current cycle, the time that the previous cycle took, and the time remaining in the current cycle. The timers display box 310 also includes M30 counters, where each M30 counter indicates a number of programs that have been run, and user defined counters. FIG. 4 shows an example of a positions display box 410 that displays a position of the machine tool 25 in a coordinate system. The positions display box also indicates that the coordinate system of the position of the machine tool 25 can be changed by toggling a "POSIT" key on the user input interface 35. FIGS. 2-4 show just a few examples of display boxes that can be used to generate a display screen. Display boxes that may be displayed on the display 40 are not limited to the example display boxes illustrated in FIGS. 2-4.

Figure 5:
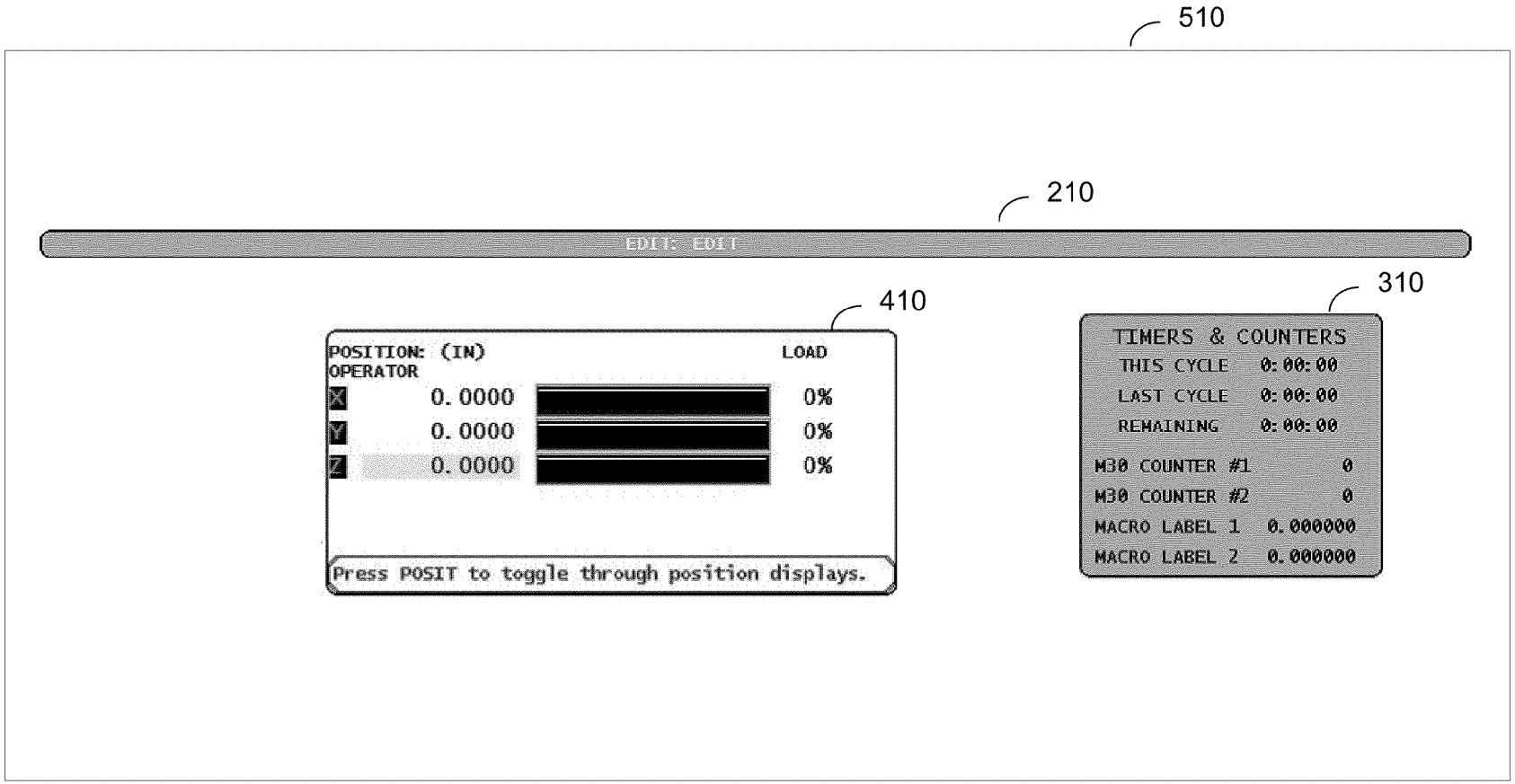
FIGS. 5-7 show examples of display screens according to aspects of the disclosure.

A display screen may be generated using any arrangement of display boxes to present various types of information to the operator at a given time. FIG. 5 shows an example of a display screen 510 generated using the operation mode display box 210, the timers display box 310 and the positions display box 410. In an aspect, the display screen is dynamically generated using display boxes based on rules, as discussed further below.

In an aspect, each display box has associated rules that determine under which conditions the display box is displayed on the display 40. Each rule may be based on a condition of the system 10 such as the operation mode of the system 10, the display mode of the system 10 or other condition of the system 10. For example, a condition of the system 10 may be based on the value of a variable in the system 10, a user input received via the user input interface 35 or a condition detected at the machine tool 20 that is reported to the controller 15 such as detected tool wear, detected tool load, the position of a tool or workpiece, model of the machine tool 20, feature of the machine tool 20, or other condition. A condition of the system 10 may also be based on one of a plurality of different modes of the system 10 that are within a particular operation mode and/or display mode. Such modes may be referred to as sub-modes.

To generate a display screen based on rules, the processor 25 includes a rules module 125 and a display module 135, each of which may be implemented by program code stored in the memory 30 and executed by the processor 25, as shown in FIG. 1. The rules module 125 generates a set of conditions based on current conditions of the system 10. For example, the set of conditions may comprise a first condition (condition 1) based on the current operation mode of the system 10, a second condition (condition 2) based on the current display mode of the system 10 and a third condition (condition 3) based on a condition of the system 10 (e.g., a sub-mode within an operation mode and/or display mode). The rules module 125 then compares the rules of each display box with the set of conditions to identify one or more display boxes having rules that are satisfied by the set of conditions. After the rules module 125 has identified the display boxes having rules that are satisfied by the set of conditions, the display module 135 generates the display screen using the display boxes identified by the rules module 125. The display screen is then displayed on the display 40 to the operator.

Examples of rule based display screen generation are provided below. In these examples, the display screen is generated using one or more display boxes selected from the operation mode display box 210, the timers display box 310 and the positions display box 410. Tables 1-3 below show examples of rules associated with the positions display box 410, the timers display box 310 and the operation mode display box 210, respectively. Each table includes rule 1, rule 2 and rule 3 corresponding to condition 1, condition 2, and condition 3, respectively, of the set of conditions of the system 10.

As shown in Table 1 below, the rules for the positions display box 410 include the memory or edit operation mode for rule 1, the positions or alarms display mode for rule 2, and an operator or machine sub-mode for rule 3.

TABLE 1

| POSITIONS_BOX | |
|---|---|
| Rule 1 | Memory or Edit |
| Rule 2 | Positions or Alarms |
| Rule 3 | Operator or Machine |

As shown in Table 2 below, the rules for the timers display box 310 include the memory mode for rule 1, the positions display mode for rule 2, and an operator or work sub-mode for rule 3.

TABLE 2

| TIMERS_BOX | |
|---|---|
| Rule 1 | Memory |
| Rule 2 | Positions |
| Rule 3 | Operator or Work |

As shown in Table 3 below, the rules for the operation mode display box 210 include any operation mode for rule 1, any display mode for rule 2, and any sub-mode for rule 3.

TABLE 3

| OPERATION_MODE_BOX | |
|---|---|
| Rule 1 | Any |
| Rule 2 | Any |
| Rule 3 | Any |

In a first example, the current operation mode, the current display mode and the current sub-mode of the system 10 are the memory operation mode, the positions display mode and the operator sub-mode, respectively. In this example, the rules module 125 generates a set of conditions that is defined by setting condition 1 to the memory operation mode, condition 2 to the positions display mode and condition 3 to the operator sub-mode. The rules module 125 then compares the set of conditions with the corresponding rules for each of the positions display box 410, the timers display box 310 and operation mode display box 210 to identify which of the display boxes have rules that are satisfied by the set of conditions.

In this example, the rules for the positions display box 410 are satisfied by the set of conditions of the system 10. Rule 1 of the positions display box 410 that the operation mode is either the memory or edit operation mode is satisfied by condition 1 of the set of conditions that the current operation mode is the memory mode. Similarly, rule 2 of the positions display box 410 that the display mode is either the positions or alarms display mode is satisfied by condition 2 of the set of conditions that the current display mode is the positions display mode. Lastly, rule 3 of the positions display box 410 that the sub-mode is either the operator or machine sub-mode is satisfied by condition 3 of the set of conditions that the current sub-mode is the operator sub-mode.

In this example, the rules of the timers box 310 are also satisfied by the set of conditions of the system 10. Rule 1 of the timers display box 310 that the operation mode is the memory mode is satisfied by condition 1 of the set of conditions that the current operation mode is the memory mode. Similarly, rule 2 of the timers box 310 that the display mode is the positions display mode is satisfied by condition 1 of the set of conditions that the current display mode is the positions display mode. Rule 3 of the timers display box 310 that the sub-mode is either the operator or work sub-mode is satisfied by condition 3 of the set of conditions that the current sub-mode is the operator sub-mode.

In this example, the rules for the operation mode display box 210 are also satisfied by the set of conditions of the system 10. Rule 1 of the operation mode display box 210 that the operation mode is any operation mode is satisfied by condition 1 of the set of conditions that the current operation mode is the memory mode. Similarly, rule 2 of the operation mode display box 210 that the display mode is any display mode is satisfied by condition 2 of the set of conditions that the current display mode is the positions display mode. Lastly, rule 3 of the positions display box 210 that the sub-mode is any sub-mode is satisfied by condition 3 of the set of conditions that the current sub-mode is the operator sub-mode. In this example, the operation mode display box is always displayed since its rules are satisfied by any operation mode, any display mode and any sub-mode.

Therefore, in this example, the rules module 125 identifies each of the positions display box 410, the timers display box 310 and the operation mode display box 210 as having rules that are satisfied by the set of conditions of the system 10. The display module 135 then generates a display screen 510 comprising all three of the display boxes as shown in FIG. 5.

Figure 6:
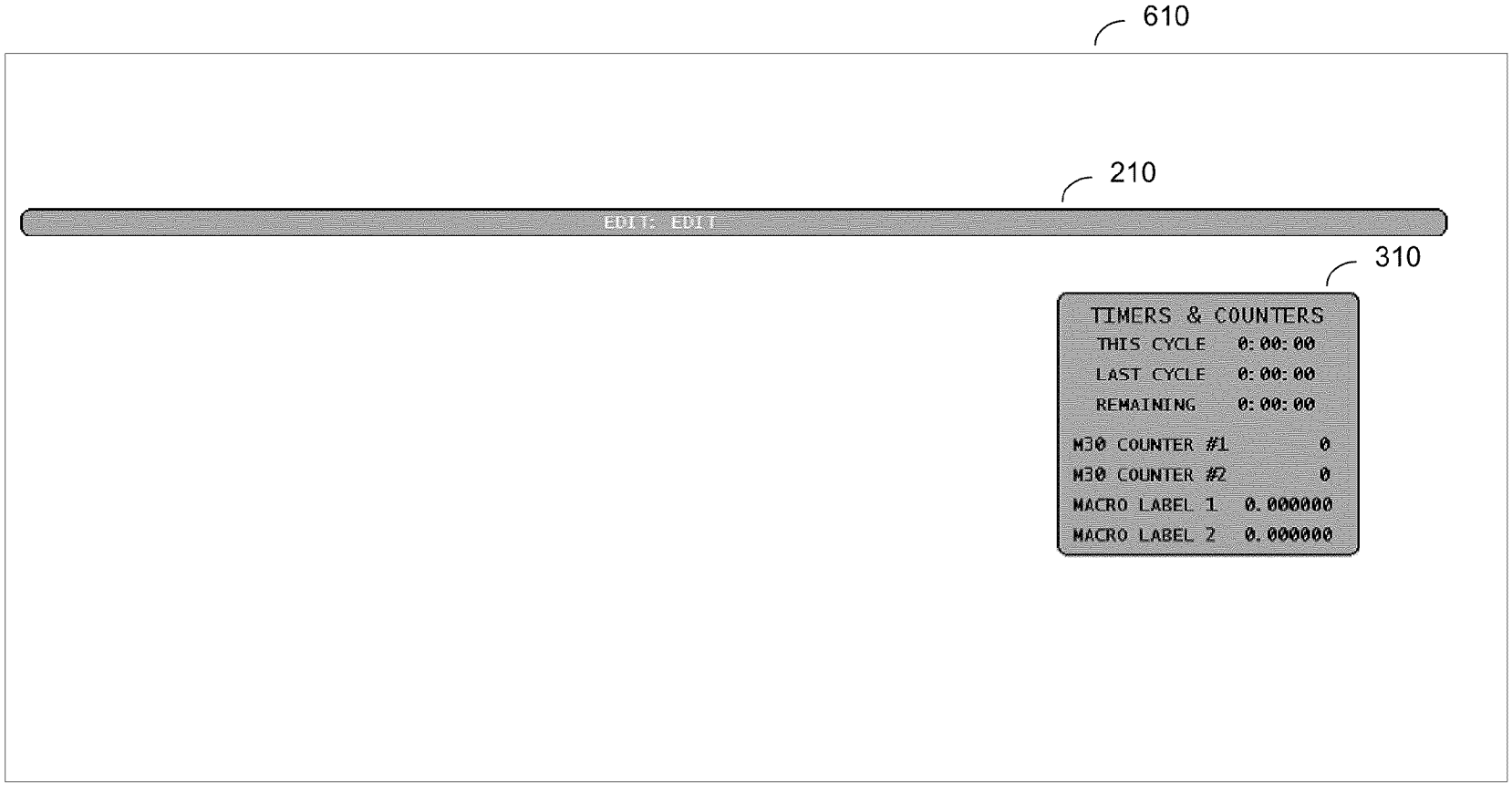

In a second example, the current operation mode, the current display mode and the current sub-mode of the system 10 are the memory operation mode, the positions display mode and the work sub-mode, respectively. In this example, the rules for the positions display box 410 are not satisfied by the set of conditions. This is because rule 3 of the positions display box 410 that the sub-mode is either the operator or machine sub-mode is not satisfied by condition 3 of the set of conditions that the current sub-mode is the work sub-mode. On the other hand, the rules for the timers display box 310 and the rules for operation mode display box 210 are both satisfied by the set of conditions. Therefore, in this example, the rules module 125 identifies the timers display box 310 and the operation mode display box 210 as having rules that are satisfied by the set of conditions. The display module 135 then generates a display screen 610 comprising the timers display box 310 and the operation mode display box 210 as shown in FIG. 6.

Figure 7:
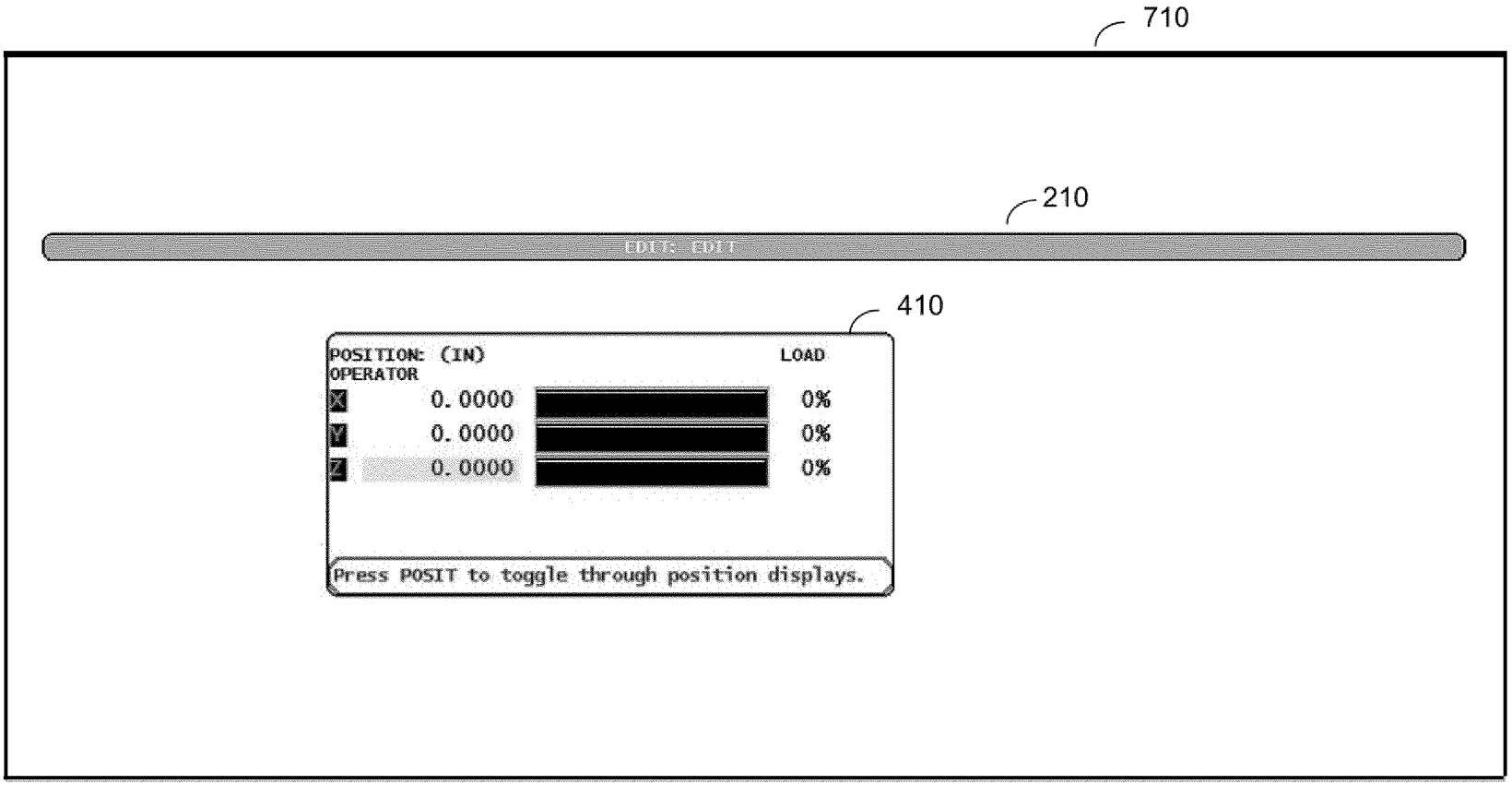

In a third example, the current operation mode, the current display mode and the current sub-mode of the system 10 are the edit operation mode, the alarm display mode and any sub-mode, respectively. In this example, the rules for the timers display box 310 are not satisfied by the set of conditions. This is because rule 1 of the timers display box 310 that the operation mode is the memory operation mode is not satisfied by the set of conditions that the current operation mode is the edit operation mode. On the other hand, the rules for the positions display box 410 and the rules for operation mode display box 210 are both satisfied by the set of conditions. Therefore, in this example, the rules module 125 identifies the positions display box 410 and the operation mode display box 210 as having rules that are satisfied by the set of conditions. The display module 135 then generates a display screen 710 comprising the positions display box 410 and the operation mode display box 210 as shown in FIG. 7.

Figure 8:
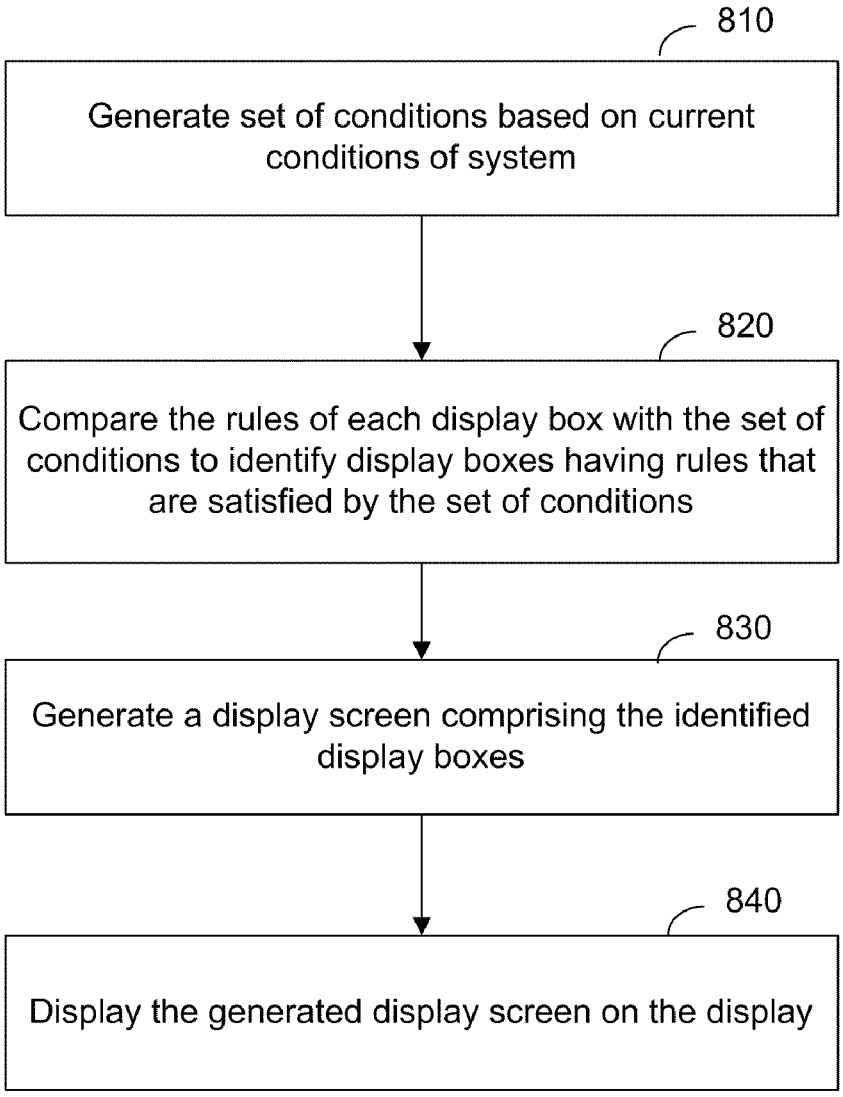
FIG. 8 is a flowchart of a process for generating a display screen based on rules according to an aspect of the disclosure.

FIG. 8 is a flowchart of a process for rule based display generation according to an aspect of the disclosure. The process may be performed by the rules module 125 and the display module 135. In this aspect, a plurality of display boxes are stored in the memory 30. Each display box may include a file with program code specifying the type of information displayed in the display box and the layout of the information in the display box. Each display box has rules associated with the display box, which specify under which conditions the display box is displayed on the display 40. The rules for each display box may also be stored in the memory 30. As discussed above, the rules may be based on conditions of the systems 10, such as the operation mode and/or display mode of the system 10.

In step 810, the process generates a set of conditions based on current conditions of the system 10. For example, the conditions may include the current operation mode, the current display mode and/or other conditions of the system 10. In step 820, the process compares the rules of each display box with the set of conditions to identify which display boxes have rules that are satisfied by the set of conditions. In step 830, the process generates a display screen comprising the display boxes identified in step 820. In step 840, the generated display screen is displayed on the display 40.

The process in FIG. 8 may be initiated when the system 10 is first powered on. The process may also be initiated each time the set of conditions changes, e.g., due to the operator changing the operation mode of the system 10.

After the display boxes are identified in step 820, the display screen may be generated in step 830 using any one of a number of different techniques. For example, the display boxes may be auto-fitted to all fit on the display 40, arranged according to one of a plurality of different layout templates or other techniques. Also, the display boxes may be arranged based on rules. For example, the rules may specify that display boxes with smaller dimensions are placed near the top of the display screen. In another example, a display box may specify a location (x and y coordinates) at which the display box is to be displayed on the display 40.

The rules based display systems and methods according to various aspects allow a programmer to quickly and easily program under which conditions a display box is displayed to the operator by simply specifying rules for the display box that correspond to the desired conditions. For example, if a programmer desires to have a display box displayed when the system is in the memory operation mode, the positions display mode and the operator sub-mode, then the programmer simply specifies rules for the display box that include the memory operation mode, the position display mode and the operator sub-mode. There is no need for the programmer to scan though the operating program of the system to determine at which locations in the operating program the system will be in the desired conditions and insert program code into the operating program at the determined locations to instruct the system to display the display box. Further, there is no need for the programmer to have detailed knowledge of the operating program to specify under which conditions a display box is displayed on the display 40.

The rules module 125 can generate a new set of conditions each time one or more conditions of the system 10 change. In this aspect, each time a new set of conditions is generated due to changed conditions of the system 10, the rules module 125 compares the rules associated with each display box with the new set of conditions to determine the display boxes having rules that are satisfied by the new set of conditions. The display module 135 then generates an updated display screen using the display boxes identified by the rules module 125. Thus, the display screen can be dynamically updated in response to changes in conditions (e.g., operation mode and/or display mode) of the system 10.

In an aspect of the disclosure, the rules module 125 can save a set of conditions so that the rules module 125 and display module 135 can quickly generate a display screen corresponding to the set of conditions at a later time. For example, if the system 10 is in the memory operation mode with a corresponding set of conditions and the operator switches the operation mode to the edit operation mode, then the rules module 125 can save the set of conditions for the memory operation mode in the memory 30. When the operator later switches the system 10 back to the memory operation mode, the rules module 125 retrieves the saved set of conditions from the memory 30. The rules module 125 then compares the rules of each display box with the retrieved set of conditions to determine the display boxes having rules that are satisfied by the retrieved set of conditions. The display module 135 then uses the display boxes identified by the rules module 125 to generate the display screen that was displayed when the system 10 was last in the memory operation mode. This allows the system 10 to quickly return to the display screen that was displayed when the system 10 was last in the memory operation mode. For example, if the set of conditions when the system 10 was last in the memory operation mode was due to user inputs from the operator, then the operator does not have to duplicate the user inputs to get to the same display screen when the system 10 returns to the memory operation mode.

In the above example, the rules module 125 can save the set of conditions for the memory operation mode by saving a portion of the set of conditions (conditions 2 and 3) and associating the saved portion of the set of conditions with the memory operation mode. When the operator switches back to the memory operation mode, the rules module 125 retrieves the saved portion of the set of conditions (conditions 2 and 3) and reconstructs the set of conditions by setting condition 1 to the memory operation mode and setting conditions 2 and 3 to the conditions 2 and 3 in the saved portion of the set of conditions.

The rules module 125 can also save a set of conditions corresponding to a first operation mode and a first display mode. In this aspect, when the operator leaves the first operation mode and the first display mode, the rules module 125 saves the current set of conditions for the first operation mode and the first display mode in the memory 30. When the operator later returns to the first operation mode and the first display mode, the rules module 125 retrieves the saved set of conditions and compares the rules of each display box with the retrieved set of conditions to identify the display boxes having rules that are satisfied by the retrieved set of conditions. The display module 135 then uses the display boxes identified by the rules module 125 to generate the display screen that was displayed the last time the system 10 was in the first operation mode and the first display mode. This allows the system 10 to quickly return to the display screen that was displayed when the system was last in the first operation mode and the first display mode.

Figure 9:
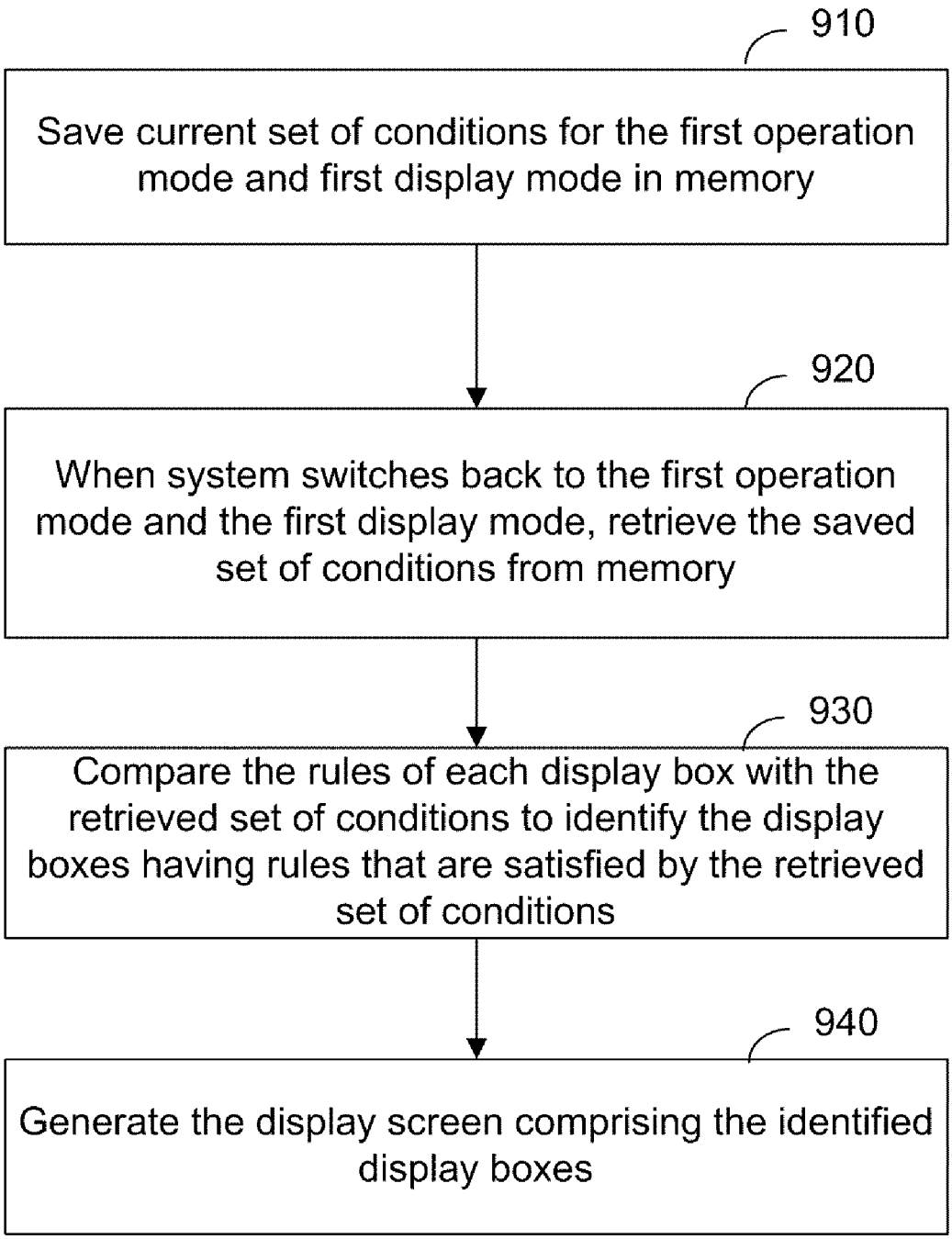
FIG. 9 is a flowchart of a process for generating a display screen when the operator returns to a previous operation mode and display mode according to an aspect of the disclosure.

FIG. 9 is a flowchart of a process for generating a display screen when the system returns to a previous operation mode and a display mode according to an aspect. The process may be performed by the rules module 125 and the display module 135. In step 910, when the operator leaves a first operation mode and a first display mode (e.g., by switching to a different operation mode), the process saves the current set of conditions for the first operation mode and the first display mode in the memory 30. In step 920, when the operator switches the system 10 back to the first operation mode and the first display mode, the process retrieves the saved set of conditions from the memory 30. In step 930, the process compares the rules of each display box with the retrieved set of conditions to identify the display boxes having rules that are satisfied by the retrieved set of conditions. In step 940, the process generates the display screen using the display boxes identified in step 930. Thus, when the operator returns the system 10 to the first operation mode and the first display mode (e.g., from another operation mode), the process generates the display screen that was displayed when the system 10 was last in the first operation mode and first display mode.

Figure 10:
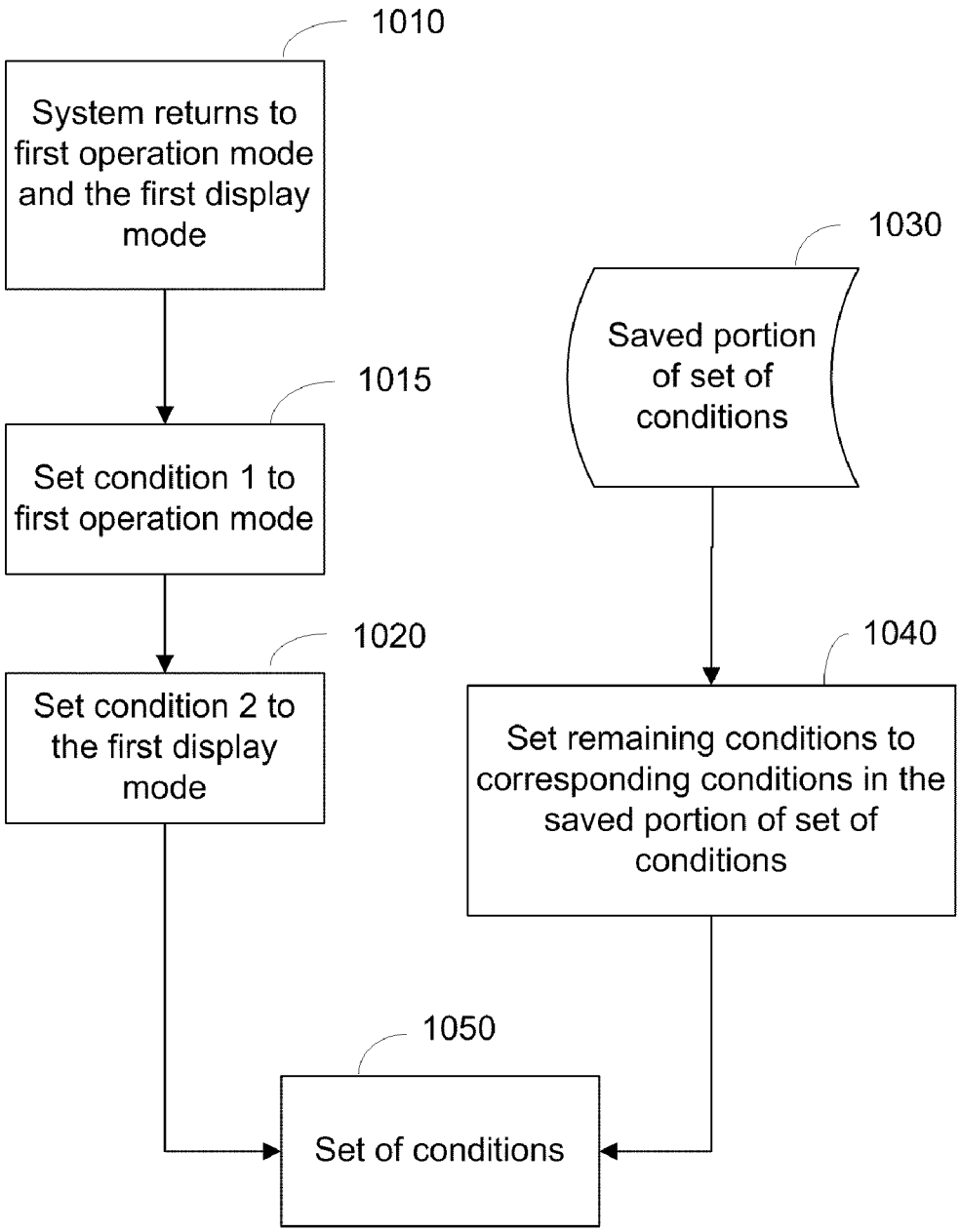
FIG. 10 is a flowchart for generating a set of conditions according to an aspect of the disclosure.

The process can save the set of conditions for the first operation mode and the first display mode by saving a portion of the set of conditions excluding conditions 1 and 2 and associating the saved portion of the set of conditions with the first operation mode and the first display mode. When the system 10 returns to the first operation mode and the first display mode, the process can retrieve the saved portion of the set of conditions and reconstruct the set of conditions by setting conditions 1 and 2 to the first operation mode and the first display mode, respectively, and using the retrieved portion of the set of conditions for condition 3. An example of this is illustrated in FIG. 10, which shows a flowchart of a process for reconstructing the set of conditions corresponding to the last time the system 10 was in the first operation mode and first display mode. In the example in FIG. 10, the set of conditions include condition 1 corresponding to the operation mode of the system and condition 2 corresponding to the display mode of the system.

In step 1010, the operator returns the system 10 to the first operation mode and first display mode (e.g., from a different operation mode). In step 1015, the process sets condition 1 to the first operation mode. In step 1020, the process sets condition 2 to the first display mode of the system. In step 1030, the process retrieves the saved portion of the set of conditions. As discussed above, the portion of the set of conditions was previously saved the last time the system 10 was in the first operation mode and the first display mode. In step 1040, the process sets the remaining conditions to the corresponding conditions in the saved portion of the set of conditions. For example, if the saved portion of the set of conditions includes a saved sub-mode, then condition 3 of the set of conditions is set to the saved sub-mode. In step 1050, the conditions in steps 1015, 1020 and 1040 are combined to reconstruct the set of conditions corresponding to the last time the system 10 was in the first operation mode and the first display mode.

Each display box may be stored in a file specifying the dimensions, layout and/or functions of the display box. A function of a display box may be specified by a function call to a program in memory 30 that performs the function. For the example of the operation mode display box 210, the function of displaying the current operation mode may be implemented by a function call to a program that retrieves and displays the current operation mode of the system 10. The function may also receive inputs from the operator via the user input interface 35 and change variables, parameters and/or settings in the system 10 based on the received inputs. In this aspect, the file of a display box may identify certain keys of the input user interface 35 that are controlled by the function of the display box to receive operator inputs, as discussed further below. The rules associated with a display box may be saved in the file of the display box or saved in a separate file that includes a display box name identifying the display box, in which case the display box name links the rules to the display box.

Figure 11:
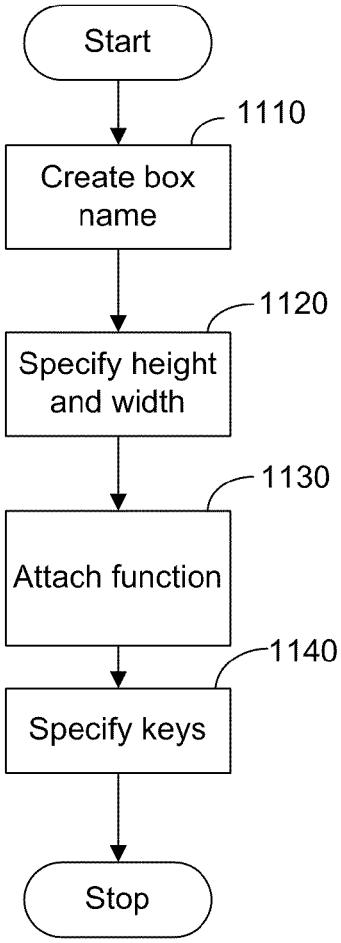
FIG. 11 is a flowchart of a process for creating a new display box according to an aspect of the disclosure.

FIG. 11 is a flowchart of a process for a programmer to create a new display box according to an aspect. In step 1110, the programmer creates a name for the display box. In step 1120, the programmer specifies a height and a width of the display box. In step 1130, the programmer attaches a desired function to the display box. The programmer may do this by specifying a function call to a program that performs a desired function. For example, if the programmer desires to include a timer in the display box, then the programmer may specify a function call to a program that provides the timer. In step 1140, the programmer specifies keys (e.g., cursor arrow keys) on the user input device 35 that are to be controlled by the display box for receiving operator inputs. As discussed further below, the display box may take control of the specified keys when the display box is displayed and is in focus. A display box may be in focus when the display box is ready to receive inputs from the operator via the user input interface 35. If the display box does not require operator inputs (e.g., the display box only displays information to the operator), then the programmer may skip step 1140. The programmer may also specify where information displayed by a function (e.g., timer) is displayed within the display box (e.g., by entering x and y coordinates within the display box).

The information in steps 1110-1140 may be placed in a file for the display box and saved in the memory 30. The display module 135 may later retrieve the information for the display box using the display box name to identify the display box. Other information that can be included in the file for a display box include feature set variables that allow adjustments to the system 10. Examples of feature set variables include large and small font features, and the addition of an action to the display box on another process.

The process of FIG. 11 allows a programmer to easily create a display box to display certain types of information to the operator. The process allows the programmer to attach desired functions to the display box to provide certain functions by specifying function calls to programs that perform the desired functions. The process also allows the programmer to specify which keys of the user input interface 35 will be controlled by the function of the display box when the display box is in focus. The programmer may program a display box at the system 10. The programmer may also program the display box at a remote computer and download the display box onto the system 10.

After a display box is created, the same programmer or another programmer can enter rules for the display box to specify under which conditions of the system 10 the display box is displayed on the display 40.

Figure 12:
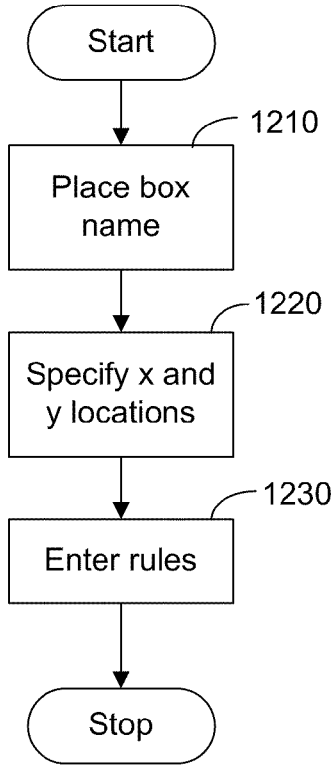
FIG. 12 is a flowchart of a process for entering rules for a display box according to an aspect of the disclosure.

FIG. 12 is a flowchart of a process for a programmer to enter rules for a display box according to an aspect. In step 1210, the programmer enters the display box name identifying the display box for which rules will be entered. In step 1220, the programmer specifies the location (x and y coordinates) on the display screen at which the display box will be displayed. Alternatively, the programmer may specify a best fit algorithm that finds an open location on the display for displaying the display box. In step 1230, the programmer enters rules specifying under which conditions the display box will be displayed. For example, if a programmer desires to have the display box displayed when the system is in the memory operation mode, the positions display mode and the operator sub-mode, then the programmer can enter the memory operation mode, the positions display mode and the operator sub-mode into the rules for the display box.

The programmer may enter the rules in step 1230 as text, numbers or a combination thereof. For example, the text may be in a natural language. In another example, different conditions of the system (e.g., operation modes) may be assigned different numbers and the programmer may specify a condition for one of the rules using the assigned number for the condition.

Thus, the process of FIG. 12 allows a programmer to specify under which conditions the display box is displayed to the operator by entering rules for the display box corresponding to desired conditions.

The programmer can enter rules for a display mode that are satisfied by different sets of conditions. For example, the programmer can do this by entering more than one operation mode for rule 1, more than one display mode for rule 2 and/or more than one sub-mode for rule 3, as was done in the examples in Tables 1 and 2 above.

The programmer can also specify that a display box is displayed in any operation mode when rules 2 and 3 are satisfied by entering "any" for rule 1 of the display box. Similarly, the programmer can specify that a display box is displayed in any display mode when rules 1 and 3 are satisfied by entering "any" for rule 2 of the display box.

The programmer can also specify that a display box is displayed in any but a specified operation mode when rules 2 and 3 are satisfied by entering "any, excluding" for rule 1 followed by the operation mode to be excluded. For example, if a programmer desires a display box to be displayed in any operation mode but the edit operation mode when rules 2 and 3 are satisfied, then the programmer can enter "any, excluding edit mode" for rule 1 of the display box. The same can be applied for rules 2 and 3.

Further, the programmer can easily modify the rules for the display box so that the display box is displayed under new sets of conditions. For example, if the programmer desires to modify the rules for a display box so that the display box is displayed in the edit operation mode when rules 2 and 3 of the set of rules are satisfied, then the programmer can simply add the edit operation mode to rule 1 for the display box. Thus, the programmer can easily modify under which conditions the display box is displayed by simply modifying the rules for the display box without the need to recode the operating program of the system 10.

Although, the rule entries discussed above were discussed using the example of rules 1-3, where rule 1 corresponds to the operation mode, rule 2 corresponds to the display mode and rule 3 corresponds to the sub-mode, the rules entries can be applied to any types of rules.

A process for generating a display screen according to an aspect will now be described with reference to FIG. 13. The process in FIG. 13 may be performed by the rules module 125 and the display module 135.

In step 1310, condition 1 of the set of conditions is set to the current operation mode. In step 1315, condition 2 of the set of conditions is set to the current display mode. In step 1320, condition 3 from the time that the current operation mode and the current display mode were last active is retrieved from memory 30. In this aspect, during the previous time that the current operation mode and the current display mode were active, condition 3 (e.g., sub-mode) was saved into the memory 30. This allows the system 10 to return to the display screen that was displayed when the operator was last in the current operation mode and the current display mode.

In step 1330, the process processes each display box based on steps 1335-1360. In step 1335, the process determines whether the rules (e.g., rules 1-3) associated with a display box are satisfied by the set of conditions. If the rules of the display box are satisfied by the set of conditions (e.g., conditions 1-3), then the process proceeds to step 1340. Otherwise, the process jumps to step 1360. In step 1340, the process retrieves display box information for the display box from memory 30. In step 1345, the process determines whether the display box is in focus. If the display box is in focus, then the display box can take control of the keys specified in the file of the display box, as discussed below. The process may determine whether a display box is in focus based on a priority, a random selection, a user selection or other techniques.

If the display box is in focus, then the process proceeds to step 1350 where the keys that are specified in the file of the display box are allocated to the function of the display box, allowing the display box to take control of these keys for receiving operator inputs. The keys that are not allocated to the function of the display box in step 1350 may be passed to the operating program of the system, which retains control of these keys. In step 1350, the process sets a key flag indicator for the display box to yes indicating that keys were allocated for the display box.

In step 1355, the display box is displayed on the display 40. If the display box is in focus, then the process may highlight the display box or display the display box in a different color from the other display boxes to inform the operator that the display box is in focus. If keys were allocated to the display box in step 1350, then the function attached to the display box processes operator inputs to the allocated keys. For example, if the allocated keys include the cursor arrow keys, then operator inputs to then cursor arrow keys are processed by the function of the display box.

In step 1360, the process determines whether there are more display boxes to process. If there are more display boxes, then the process returns to step 1330 to process another display box. If there are no more boxes, then the process proceeds to step 1365.

In step 1365, the current state of condition 3 for the currently active operation mode and the display mode is saved in the memory 30. This allows the process to generate the current display screen when the operator leaves the current operation mode and the current display mode and later returns to the current operation mode and the current display mode.

When one or more conditions of the system 10 change, the process can return to step 1310 and perform steps 1310-1365 to update the display screen. For example, if the sub-mode changes in the current operation mode and the current display mode due to system operations and/or user input, then condition 3 may be set to the new sub-mode and the process may repeat steps 1310-1365 to update the display screen. In this case, condition 3 does not have to be retrieved in step 1320.

Figure 13:
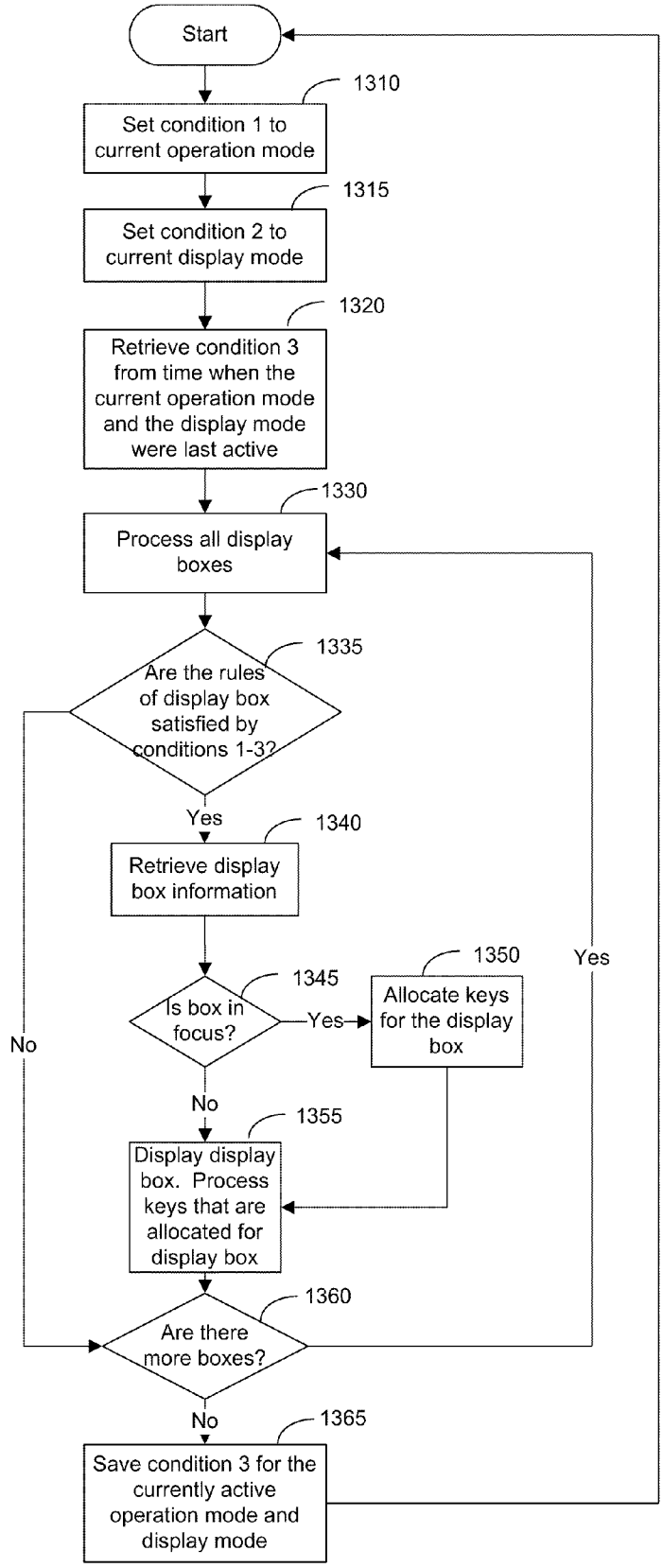
FIG. 13 is a flowchart of a process for generating a display screen based on rules according to another aspect of the disclosure.

The process in FIG. 13 may determine that two or more display boxes are in focus. When two or more display boxes are in focus, then operator inputs to keys allocated to the display boxes are directed to respective ones of the display boxes. When two or more display boxes in focus specify the same key, then operator inputs to this key may be directed to both display boxes.

Figure 14:
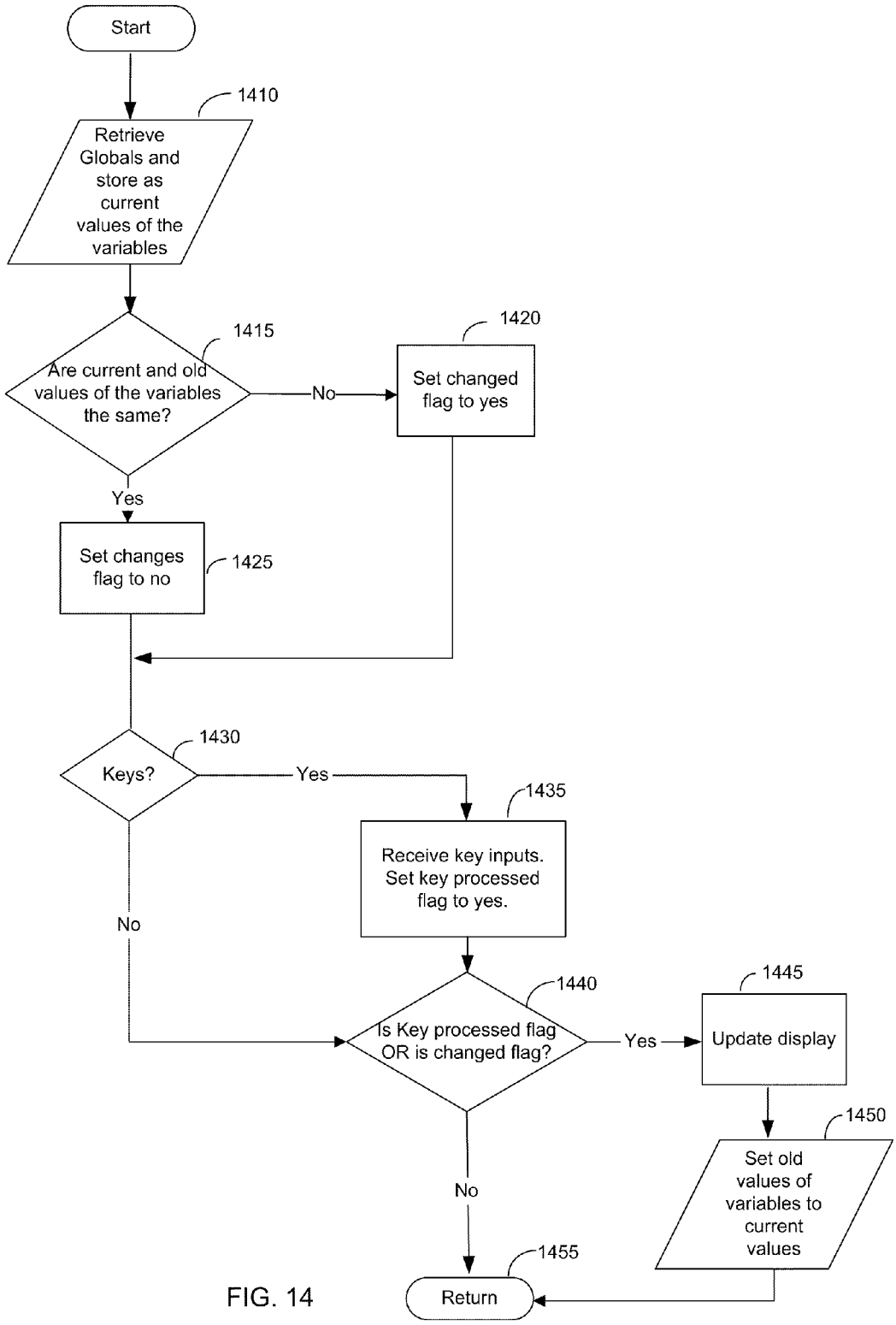
FIG. 14 is a flowchart of a process for displaying a display box according to an aspect of the disclosure.

FIG. 14 is a flowchart of a process for displaying a display box according to an aspect of the disclosure. The process of FIG. 14 may be performed in step 1355 of FIG. 13. In step 1410, the process retrieves the values of variables to be displayed in the display box from the memory 30 and sets the retrieved values as current values of the variables. The current values of the variables may be based current conditions of the system 10. In step 1415, the process compares the current values of the variables with old values of the variables to determine whether they are the same. The old values of the variables may be previous values of the variables stored in the memory 30. If the current and old values of the variables are not the same, then the process proceeds to step 1420. In step 1420, the process sets a changed flag indicator to yes, which indicates that the display box has to be updated to reflect the current values of the variables. If the current and old values of the variables are the same, then the process proceeds to step 1425, where the changed flag indicator is set to no. In this case, information in the display box that is based on the old values of the variables does not need to be updated.

In step 1430, the process determines whether keys were allocated for the display box. The process may do this by checking whether the key flag indicator was set to yes in step 1350 of FIG. 13. If keys were allocated for the display box, then the function of the display box processes operator inputs to the allocated keys in step 1435. The process sets a key processed flag indicator to yes if an operator input is received via one or more of the allocated keys. The key processed flag indicator set to yes indicates that the display needs to be updated based on operator inputs to the allocated keys.

In step 1440, the process determines whether the key processed flag indicator or the changed flag indicator is set to yes. If either one is set to yes, then the process proceeds to step 1445. Otherwise, the process proceeds to step 1455.

In step 1445, the process updates the display box on the display 40. If the key processed flag indicator is set to yes, then the function of the display box updates the display box based on operator inputs received via one or more of the allocated keys. For example, if the display box displays program code that is being edited by the user and the allocated keys include the cursor arrow keys, then the function scrolls through the program code displayed in the display box based on operator inputs to the cursor arrow keys. If the changed flag indicator is set to yes, then the function updates the values of the variables used for the display box with the current values of the variables. The current values of the variables may be based on operator inputs to the system 10 and/or changes in conditions of the system 10 that affect the values of the variables. In step 1450, the process updates the old values of the variables with the current values of the variables.

In step 1455, the process returns to step 1410 to determine whether the display box needs to be updated again due to changes in the values of the variables and/or operator inputs to the allocated keys. When the process returns to step 1410, the key processed flag indicator may be reset to no.

The process of FIG. 14 updates the display box on the display 40 when the values of the variables change and/or operator inputs to the allocated keys are received. In this aspect, when the values of the variables do not change or no operator inputs are received on the allocated keys, the display box is not updated. Thus, processing resources are not wasted redrawing a static display box.

The methodologies described herein may be implemented by various means depending upon the application. For example, these methodologies may be implemented in hardware, firmware, software or a combination thereof. For a hardware implementation, the processors may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, electronic devices, other electronic units designed to perform the functions described herein, or a combination thereof.

For a firmware and/or software implementation, the methodologies may be implemented with modules (e.g., procedures, functions, and so on) that perform the functions described herein. Any machine readable medium tangibly embodying instructions may be used in implementing the methodologies described herein. Memory may be implemented within the processor or external to the processor. As used herein the term "memory" refers to any type of long term, short term, volatile, nonvolatile, or other memory and is not to be limited to any particular type of memory or number of memories, or type of media upon which memory is stored.

The memories described in the disclosure may comprise machine readable media. Machine readable media may include storage integrated into a processor, such as might be the case with an ASIC, and/or storage external to a processor. By way of illustration, and not limitation, readable media may include one or more of volatile memory, nonvolatile memory, a Random Access Memory (RAM), a flash memory, a Read Only Memory (ROM), a Programmable Read-Only Memory (PROM), an Erasable PROM (EPROM), a register, a hard disk, a removable disk, a CD-ROM, a DVD, or any other suitable storage device. In addition, readable media may include a transmission line or a carrier wave that encodes a data signal. A readable medium may be a machine readable media encoded or stored with a computer program or instructions. The computer program or instructions may be executable by a transmitter or receiver device or by a processor of a transmitter or receiver device.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

Examples of particular communications protocols and formats have been given to illustrate the subject technology. However, the subject technology is not limited to these examples and applies to other communications protocols and formats.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A method for displaying information in a system including a computer numerical controlled machine tool, the system comprising a plurality of display boxes stored in a memory, each display box having rules associated with the display box, the rules for each display box specifying under which conditions the display box is to be displayed, the method comprising:

generating a set of conditions based on current conditions of the system including a condition detected at the computer numerical controlled machine tool;

comparing the rules for each display box with the set of conditions to identify one or more of the display boxes having rules that are satisfied by the set of conditions;

generating a display screen comprising the identified one or more of the display boxes; and displaying the display screen on a display, wherein one or more of the display boxes comprises at least one variable based on the condition detected at the computer numerical controlled machine tool.

2. The method of claim 1, wherein the set of conditions comprises an operation mode of the system.

3. The method of claim 2, wherein the set of conditions comprises one of a plurality of sub-modes within the operation mode of the system.

4. The method of claim 1, wherein the set of conditions comprises a current display mode of the system.

5. The method of claim 4, wherein the set of conditions comprises one of a plurality of sub-modes within the display mode of the system.

6. The method of claim 1, wherein the condition detected at the computer numerical controlled machine tool is a tool load, a tool wear, a position of a tool or a position of a workpiece.

7. The method of claim 1, wherein the condition detected at the computer numerical controlled machine tool comprises a model of the computer numerical controlled machine tool or feature of the computer numerical controlled machine tool.

8. The method of claim 1, further comprising:

saving a portion of the set of conditions in the memory when an operator switches the system from a first operation mode to a second operation mode;

retrieving the portion of the set of conditions from the memory when the operator switches the system back to the first operation mode; and reconstructing the set of conditions based on the first operation mode and the retrieved portion of the set of conditions.

9. The method of claim 1, further comprising:

saving a portion of the set of conditions in the memory when an operator switches the system from a first display mode to a second display mode;

retrieving the portion of the set of conditions from the memory when the operator switches the system back to the first display mode; and reconstructing the set of conditions based on the first display mode and the retrieved portion of the set of conditions.

10. The method of claim 1, wherein a function is attached to a first display box in the plurality of display boxes, further comprising:

if the first display box has rules that are satisfied by the set of conditions, allocating one or more keys of the system to the first display box, wherein the one or more keys are configured to receive user inputs; and processing user inputs received by the one or more keys using the function attached to the first display box.

11. A rule based display system for a computer numerical controlled machine tool, comprising:

a memory storing a plurality of display boxes, each display box having rules associated with the display box, the rules for each display box specifying under which conditions the display box is to be displayed;

at least one processor configured to comprise a plurality of modules including at least:

a rules module configured to generate a set of conditions based on current conditions of the system including a condition detected at the computer numerical controlled machine tool, and to compare the rules of each display box with the set of conditions to identify one or more of the display boxes having rules that are satisfied by the set of conditions; and a display module configured to generate a display screen comprising the identified one or more of the display boxes; and a display configured to display the display screen, wherein one or more of the display boxes comprises at least one variable based on at least the condition detected at the computer numerical controlled machine tool.

12. The system of claim 11, wherein the set of conditions comprises an operation mode of the system.

13. The system of claim 11, wherein the set of conditions comprises one of a plurality of sub-modes within the operation mode of the system.

14. The system of claim 11, wherein the set of conditions comprises a current display mode of the system.

15. The system of claim 11, wherein the condition detected at the computer numerical controlled machine tool is a tool load, a tool wear, a position of a tool or a position of a workpiece.

16. The system of claim 11, wherein the rules module is configured to save a portion of the set of conditions in the memory when an operator switches the system from a first operation mode to a second operation mode, to retrieve the portion of the set of conditions from the memory when the operator switches the system back to the first operation mode and to reconstruct the set of conditions based on the first operation mode and the retrieved portion of the set of conditions.

17. The system of claim 11, wherein the rules module is configured to save a portion of the set of conditions in the memory when an operator switches the system from a first display mode to a second display mode, to retrieve the portion of the set of conditions from the memory when the operator switches the system back to the first display mode and to reconstruct the set of conditions based on the first display mode and the retrieved portion of the set of conditions.

18. The system of claim 11, wherein a function is attached to a first display box in the plurality of display boxes, and if the first display box has rules that are satisfied by the set of conditions, the rules module is configured to allocate one or more keys of the system to the first display box, wherein the one or more keys are configured to receive user inputs and user inputs received on the one or more keys are processed by the function attached to the first display box.

19. A computer numerical controlled machine tool system, comprising:

a machine tool;

a controller configured to comprise a plurality of modules including at least:

a rules module configured to generate a set of conditions based on current conditions of the system including a condition detected at the machine tool, and to compare rules associated with each of a plurality of display boxes with the set of conditions to identify one or more of the display boxes having rules that are satisfied by the set of conditions; and a display module configured to generate a display screen comprising the identified one or more of the display boxes; and a display configured to display the display screen, wherein the set of conditions comprises an operation mode of the system, at least one sub-mode within the operation mode of the system, and a current display mode of the system.

20. A method for displaying information in a system comprising a plurality of display boxes stored in a memory, each display box having rules associated with the display box, the rules for each display box specifying under which conditions the display box is to be displayed, the method comprising:

generating a set of conditions based on current conditions of the system;

comparing the rules for each display box with the set of conditions to identify one or more of the display boxes having rules that are satisfied by the set of conditions;

generating a display screen comprising the identified one or more of the display boxes;

displaying the display screen on a display;

saving a portion of the set of conditions in the memory when an operator switches the system from a first operation or display mode to a second operation or display mode;

retrieving the portion of the set of conditions from the memory when the operator switches the system back to the first operation or display mode; and reconstructing the set of conditions based on the first operation or display mode and the retrieved portion of the set of conditions.

* * * * *